United States Patent [19]

Asada et al.

[11] 3,937,385

[45] Feb. 10, 1976

[54] METHOD OF MANUFACTURING COMPOUND BILLETS FOR HYDROSTATIC EXTRUSION

[75] Inventors: Tsunesaburo Asada, Minoh; Takefumi Horiuchi; Kiyoshi Matsumoto, both of, Kobe; Yoshiyuki Monju, Nishinomiya; Yoshihiro Yamaguchi, Ashiya; Masataka Noguti, Nishinomiya; Masao Nishihara, Kyoto; Tatsu Fujita, Kobe; Tomiharu Matsushita, Nishinomiya, all of Japan

[73] Assignee: Kobe Steel Ltd., Kobe, Japan

[22] Filed: Feb. 28, 1975

[21] Appl. No.: 553,991

Related U.S. Application Data

[63] Continuation-in-part of Ser. No. 316,923, Dec. 20, 1972, abandoned.

[52] U.S. Cl. ..... 228/131; 228/126

[51] Int. Cl.[2] ..... B23K 37/00

[58] Field of Search ..... 228/126, 131, 155, 156, 228/160, 161; 29/505, 527.1

[56] References Cited

UNITED STATES PATENTS

| | | | |
|---|---|---|---|
| 3,208,257 | 9/1965 | Holub | 72/108 |
| 3,509,617 | 2/1968 | Winter | 228/126 X |
| 3,601,884 | 8/1971 | Kemeny | 29/471.5 |
| 3,602,978 | 4/1969 | Oaks | 29/471.1 |
| 3,604,102 | 9/1971 | Boccalari | 29/474.3 |
| 3,678,567 | 7/1972 | Manilla | 29/420.5 |
| 3,854,193 | 12/1974 | Yamaguchi | 228/156 X |

*Primary Examiner*—James L. Jones, Jr.
*Assistant Examiner*—Margaret Joyce
*Attorney, Agent, or Firm*—Oblon, Fisher, Spivak, McClelland & Maier

[57] ABSTRACT

In the manufacture of compound billets composed of two or more different metals for use in hydrostatic extrusion, care must be exercised to see whether or not products possessing a predetermined compound status are produced from the compound billets by means of the hydrostatic extrusion process. The compound billets manufactured through the method of this invention do not, in the hydrostatic extrusion process, possess the usual defects caused by discrepancies between the mechanical properties of a plurality of different metallic materials constituting the billets, especially, and in particular, it is true that the compound billets are free from defects caused by surface slip taking place between the surfaces of the internal and external layer materials of the compound billet of the different metallic materials, and the method according to the present invention is characterized in that the formation of the nose part is undertaken by plastic forming of the same, such as roll forming and swazing, from the outside while maintaining an interior condition wherein air is expelled from the space formed between the contacting surfaces of the different metallic materials. As a result, the materials are mechanically bonded together and the surface areas of the materials of the billet at the deformed nose portion to be presented to the die are equal and it becomes possible to carry out a hydrostatic extrusion of the compound materials under a combination of different metallic materials covering an extremely wide selection.

11 Claims, 9 Drawing Figures

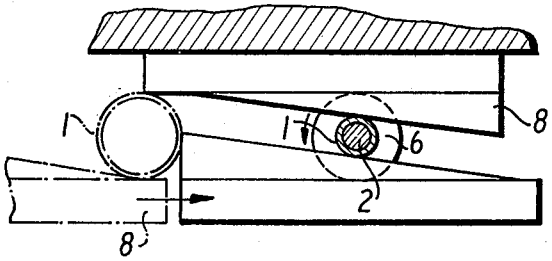
FIG. 3a
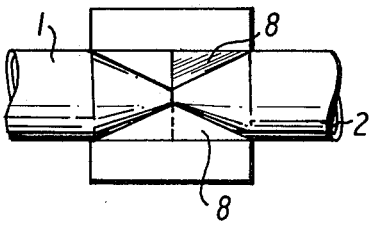
FIG. 3b
FIG. 4a
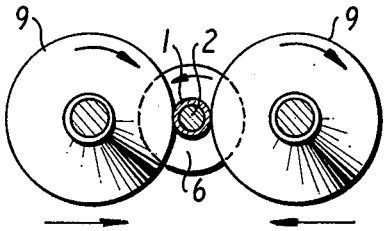
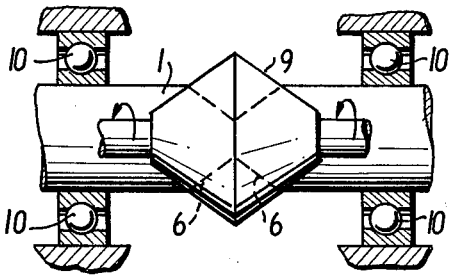
FIG. 4b
FIG. 5
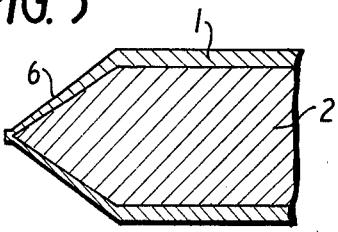
FIG. 6
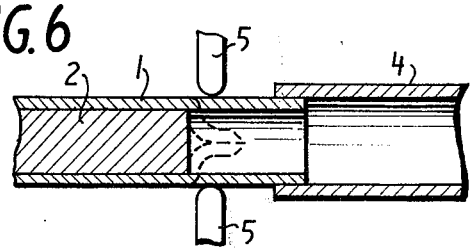
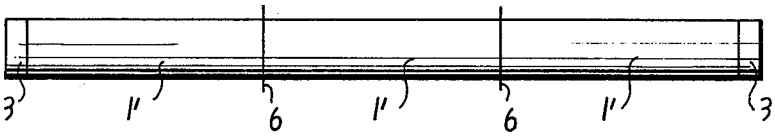
FIG. 7

METHOD OF MANUFACTURING COMPOUND BILLETS FOR HYDROSTATIC EXTRUSION

CROSS-REFERENCE TO RELATED APPLICATIONS

The present application is a continuation-in-part application of application Ser. No. 316,923, filed Dec. 20, 1972, now abandoned.

BACKGROUND OF THE INVENTION

1. Field of the Invention:

The present invention relates generally to an improved method of hydrostatic extrusion of compound billets composed of more than two different metallic materials and, more particularly, to an improved method of obtaining stable and satisfactory products covering an extremely wide selection of combinations of different metallic materials as well as the shapes thereof.

2. Description of the Prior Art:

It is known, as disclosed in U.S. Pat. No. 3,620,059, that a compound billet may be formed by hydrostatically extruding an internal material and an external material, each one being of more than two different materials.

However, even in the case of effecting a hydrostatic extrusion by employing a sealed billet, as hereinbefore mentioned, there are still a number of problems to be solved. For instance, in the event there is a great difference between the deformation resistance of the different metallic materials, satisfactory products will not be obtained due to the fact that surface slip will take place at the contact plane of the different materials and further due to the fact that such surface slip will be intermittent, whereby wave-shaped irregularities occur on the products and sometimes at least one of the different metallic materials is thereby destroyed.

Further, surface slip of the different metallic materials is not only due to the difference between the deformation resistance of the different metallic materials, but is also affected by the compatibility of the different metallic materials, the degree of cleanliness of the surfaces thereof, the contact pressure at the time of deformation, and the like. Therefore, in order to manufacture products whose range enables a free and wide selection of combinations of different metallic materials and the shapes thereof, a solution of the problems has been difficult within the framework of complex conditions caused by the instability due to the aforementioned surface slip and intermittent surface slip phenomena.

SUMMARY OF THE INVENTION

The purpose of the present invention is to solve the aforementioned problems and provide a method of manufacturing compound billet products by means of a hydrostatic extrusion process through which satisfactory products can be obtained with stability by covering numerous combinations of different metallic materials and shapes thereof. In other words, compound billets for hydrostatic extrusion obtained according to this invention should avoid the instability caused by surface slip and intermittent slip taking place between the contact surfaces of the different metallic materials. The primary object of this invention therefore is to manufacture compound billets which, during the hydrostatic extrusion process, do not cause surface slip between the contact surfaces of the different metallic materials covering numerous combinations and shapes.

Another object of this invention is to efficiently produce compound billets which are employed for the attainment of the primary object of this invention and, further, to eliminate defects taking place during the production process of such compound billets.

A further object of this invention is to provide the most efficient actual working conditions and working process for the attainment of the aforementioned primary object.

Another object of this invention is to provide for stable extrusion of compound billets from the beginning of the extrusion process to attain the primary object in view of the fact that it is at the initial stage of extrusion processes that the occurrence of particularly unstable conditions are most likely to take place in the hydrostatic extrusion process.

The foregoing and other objects are attained according to the present invention through the provision of a method of producing compound billets for hydrostatic extrusion characterized by the steps of: Cleaning the contact surfaces of the internal material and the external material; sealing a space provided between the contact surfaces while the air existing within the space is expelled; and applying a plastic forming process to the compound billet blank from the outside thereof while the interior space thereof is maintained in a vacuum condition, thereby forming a compound billet, both the external and internal materials of which possess a nose part which has been formed in the shape of a cone and which have been mechanically bonded tightly together so as to create a kind of cainozoic bonding at the contacting surfaces.

By means of effecting the plastic forming from the outside of the compound material while maintaining the space between the internal and external materials in a vacuum condition, the different metallic materials will be positively pressed and bonded together so that the transmission of force between the different metallic materials, which is generally expressed in terms of the shearing force or friction force at the surfaces, will be ensured and therefore surface slip and discontinuous or intermittent surface slip will be prevented over a wide range.

Further, according to the present invention, it is also possible to prevent slip even when the respective deformation resistances of the different metallic materials differ vastly from each other to such an extent as to make it impossible to prevent such slip by means of employing billets produced through the conventional methods. The force exerted in the axial direction between the different metallic materials during the hydrostatic extrusion is not such a simple friction force constituting a functional relationship between the extent of the force in the direction of the radius and the conditions of the related surfaces, but is such a force which is affected by other conditions created by the fact that the different metallic materials themselves are also subject to the deformation. For example, the other conditions include the point as to whether or not plastic deformation is taking place at the surfaces where the different metallic materials come into contact with each other, or, as to whether or not a compatible force is applied between the two surfaces of the different metallic materials.

The steps incorporated in the invention insure that the transferrable axial directional force between the different metallic materials is sufficient under all such other conditions a mentioned above, thereby preventing the occurrence of surface slip and intermittent slip. Further, in order to put the invention into practice more effectively and economically, while enhancing the stability of the operation by preventing such defects from taking place during the production process, a plural number of the compound billets should be formed from a single raw material by effecting plastic working to portions of the raw material which are not the end parts thereof at the time of plastically forming the nose part in which both the internal and external materials are transformed together into the shape of a cone by means of such plastic working, which is done to the raw material from the outside while maintaining a substantial vacuum within the space between the contact surfaces of the internal and external materials.

Such production of a plural number of compound billets from a single raw material not only reduces the extent of the air-expelling work needed, but also provides an extremely effective condition for carrying out the forming process while maintaining the vacuum atmosphere. In other words, although the compound billets will be eventually sheared away at the stage of forming there is a possibility that atmospheric air may intrude into the space formed between the internal material and the external material, both of which are of different material to each other, before and after the shearing operation. Therefore, the production of a plural number of compound billets from a single raw material is effective for the prevention of such intrusion of the atmospheric air. Further, in order to put the invention into practice more effectively at the production stage, the condition of the remaining air inside the said space after the air-expelling operation should be at $10^{-2}$ torr, or $10^{-3}$ torr for the better, at the time of forming the raw material in which the space between the material surfaces is sealed under the air expelled condition.

The lower the extent of the remaining air inside the space at the time of the air expelling operation, it is expected, the better will be the results obtained for the attainment of the purposes of the invention. The effect of the invention will be further enhanced if a lower limit be set as a limitation for attaining the most conspicuous effect of the air expelling operation. Further, in order to put the invention into practice more effectively, it is necessary to stabilize the initial stage of the extrusion operation. For this purpose, it is extremely effective to form a certain extent of unevenness, that is, concavity or convexity, at a predesignated position on at least one of the two contacting surfaces of the external and internal materials to which the machining is to be effected, prior to carrying out the cleaning of the surfaces of the internal and external materials and also, that the plastic working be effected in such a manner, that, at the time of forming the nose part which is to be transformed into a conical shape for both the internal and external materials by way of applying plastic working from outside the raw material while maintaining the air-expelled status, the nose part possesses at the tip end part thereof a small parallel area having cross-sectional parallel layers for both the internal and external materials, that is, the areas of the external and internal members being presented to the die are equal. Further, the length of the small parallel area satisfies the condition that the shearing strength at the contacting surface of the internal and external materials should be equal or higher than the yield stress of one of the raw materials composing different metallic materials having a greater degree deformation of resistance.

The above-mentioned conditions, that is the plastic deforming process whereby the conical nose portion of the billet is produced wherein the members are mechanically bonded together and present the same surface areas to the die, are for the attainment of effective initial stage stability of operation. By satisfying these conditions, the stabilized initial stage of operation can be achieved in view of the fact that the surface slip and the intermittent slip are particularly likely to take place during the initial stage of the hydrostatic extrusion operation, and, the length of the small parallel part can be calculated by means of increasing the transferable force between the different metallic materials and also by means of assessing the mechanical properties of the different metallic materials as well as the extent of the transferable force.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference numerals designate like or corresponding parts and wherein:

FIGS. 2, 3*a*, 3*b*, 4*a* and 4*b* are explanatory views of the steps for forming the achievement of the nose shape;

FIG. 5 is a cross-sectional view of the main part of the cone-shaped nose part;

FIG. 6 is an explanatory view of the air-tight sealing by means of compression; and FIG. 7 is an explanatory view for producing a plurality of billets from a material according to the invention.

DETAILED DESCRIPTION OF THE PREFERRED EMBODIMENTS

Figure 1:
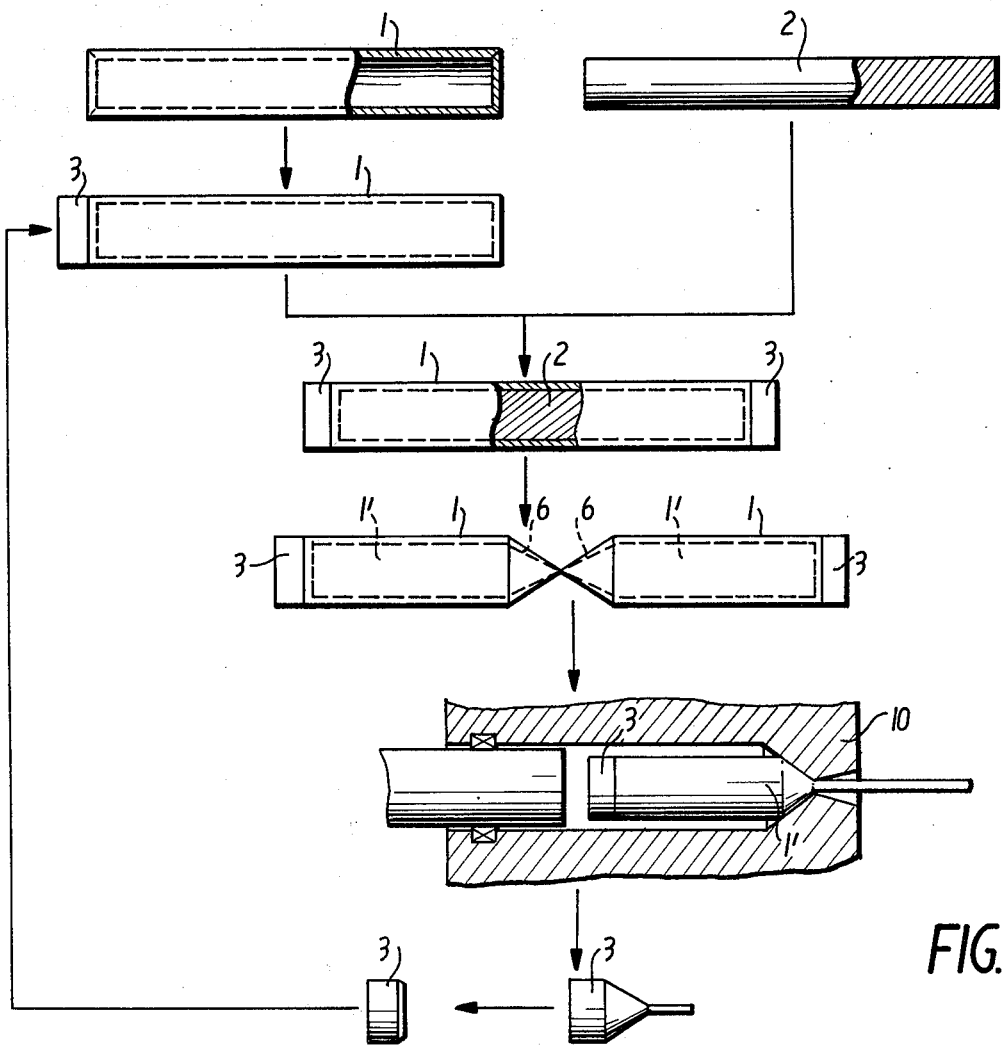
FIG. 1 is an explanatory view illustrating the steps of the method according to the present invention.

Referring now to the drawings, and more particularly to FIG. 1 thereof, the production steps of the present invention are shown sequentially as indicated by the arrow marks. In this invention, external member 1 and internal member 2 are first prepared from the separate materials. For instance, the external member 1 may be prepared from copper, while the internal member 2 may be prepared from aluminum, aluminium alloy, super conducting titanium or niobium alloy or similar metallic materials. In the invention, even in the event that the deformation resistance of the internal member 2 is higher than that of the external member 1, or vice versa, a stable extrusion operation can be secured. In any event, stable extrusion is attainable even when there is a difference in the extent of deformation resistances between the external member 1 and internal member 2. The external member 1 can be formed from a hollow ingot or a hot-rolled extruded material whose internal and external surfaces are ground or machined to a smooth finish. Welded pipes, etc. made by forming and welding a plate material can also be used for the member 1. The length of such member is selected to be more than twice as long, or even higher multiples of the length, as the billet to be produced from the operation of this invention.

The internal member 2 can be made from a solid ingot or plastic-worked material thereof, and the length of the internal member is selected, as in the case of the external member 1, to be equal to some multiple of the billet length to be produced from this operation.

The internal surface of the external member 1 and the external surface of the internal member 2 are then treated by an acid washing, water washing, defattening, annealing, or other cleaning process or pretreatment operation in accordance with the conditions necessitated by the nature of the material employed and then, a round disc stopper 3, made of the same material as that of the external member 1 or of a different material but weldable to the external member 1, is prepared and welded to one open end of the external member 1 for sealing the same. If the oxidation caused at the time of welding and at the welded parts should present any problem, this stopper sealing process could preferably be carried out prior to the cleaning treatment described above, or in the alternative, the welding operation may also be carried out within an inert gas atmosphere.

As a further alternative, the stopper 3 need not necessarily be employed at all. In this case, the external member 1 is prepared with a superfluous length so as to include an allowance for a subsequent forming operation in the course of which the extra length is pressed together so as to provide the desired seal. To the inside of the external member 1, which has been sealed on its one end by means of the stopper 3, or by means of one of the other methods as described above, the internal member 2 is fitted whereupon the other open end of the external member 1 is also stopped and sealed by means of welding another stopper 3 under vacuum conditions, that is, under those conditions wherein the air in the space between the external member 1 and the internal member 2 has been expelled.

In the event that the stopper 3 is employed at one end, the welding under vacuum condition may be accomplished as shown in FIG. 6, illustrating however a different embodiment of the invention, wherein a suction tube 4 of a vacuum pump may be connected to the other open end of the external member 1 so that, as the air is discharged from the space by means of the suction tube 4, the other open end can be closed by forcing the fringe portions thereof inwardly together by means of a press tool 5 so as to provide the desired seal, as indicated by the dotted lines in FIG. 6. In the welding and sealing operation utilizing the stopper means 3, any of the processes of arc welding, resistance welding, friction welding, or other welding technique may be resorted to, although resistance welding is most advantageous from an economical point of view. Such sealing connection may of course also be effected mechanically or by the use of adhesives. The compound billet material, both ends of which have been sealed air-tight and with the air from the space between the external member 1 and the internal member 2 having been expelled, can thus be obtained.

In the present embodiment, two pieces of such compound billets are initially prepared, the central or connecting part thereof being formed with an advantageous configuration for carrying out the hydrostatic extrusion by means of plastic working. For example, the compound billet may be formed into two parts having conical or pointed ends so that two complete billet bodies 1′ can be obtained after separating the thus formed billet material. With respect to the formation and separation of the conical portions so as to in fact separate the billet material into the completed pair of billet bodies 1′ there is an exemplary method shown in FIGS. 2, 3 and 4.

Figure 2:
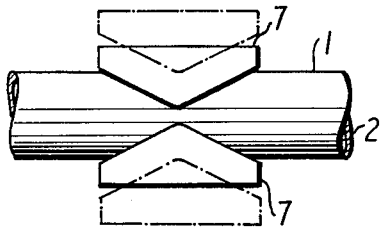

Referring now to FIG. 2, there is shown a forging method in which a pair of metallic dies 7 are employed, one upon the upper portion and another upon the lower portion of the members 1 and 2 as viewed in the figure, the sides of the dies corresponding to the desired conical shape. The compound billet material is rotated in one direction so that a pair of conical-shaped nose portions are gradually formed, as shown in FIGS. 3*a* and 3*b*, by means of a pair of blades 8 which have a wedged-shaped cross-section and which are movably actuated in directions opposite to one another.

Alternatively, as shown in FIGS. 4*a* and 4*b*, the raw material for the compound billet may be pinched between a pair of rotating dies or blades 9, which are of the abacus bead shape and which are positioned face to face and, whereupon either the pinched material or the pair of rotating blades 9 is positively driven so that the rotating blades 9 are brought to positions adjacent the center of the material, in synchronization with each other, whereby a pair of the desired cone-shaped nose portions are obtained.

Although any one of the above-mentioned methods can be used, an axial elongation of the material will take place in the course of forming the desired conical-shaped nose portions. Therefore, in order to prevent the possible deviation of the compound billet material without impeding its axial elongation, it is necessary to install an anti-swinging device 10 as shown in FIG. 4 which may take the form of ball bearings or the like. The two pieces of completed compound billets 1′ can thus be obtained simultaneously with the formation and separation of the nose portions 6.

The cross-sectional shape of the thus formed and separated nose portions 6 will facilitate the presentation of approximately the same surface area for both the external member portion 1 and the internal member portion 2 as shown in FIG. 5. In addition, as a result of such plastic deforming process, the external member 1 and the internal member 2 are mechanically bonded together so as to create a kind of metallurgical cainozoic bonding at the contacting surfaces and within the nose portion 6 thereof due to the previous deformation operation, while the vacuum condition as well as the air-tight sealing between the two materials can be securely maintained during the course of the formation of the nose sections 6.

The compound billet 1′ thus obtained is thus configured and is already in condition for the extrusion operation and may then in fact be extruded from the die 10 of an ordinary hydrostatic extruder as again shown in FIG. 1 with the conical-shaped nose portion 6 as the leading part, whereby the desired compound material can be obtained. The mechanical bonding permits the surface areas of the materials of the billet to always be the same throughout the extrusion thereof as the billet continuously passes through the die which of course prevents the aforenoted surface slip and leads to a sound and stable extrusion product. The stopper 3 which remains after completion of the extrusion operation can be detached from the remaining unextruded portion of billet 1′ so that it can again be used as a stopper for other external members 1 and internal members 2.

The process of formation and separation of the above-mentioned nose sections 6 may also be performed under heating. According to the present invention, it is possible to provide a temperature below the level of which a harmful alloy will be produced from the different metallic materials constituting the compound billet blank by using high frequency heating or flame heating methods wherein both members 1 and 2 can be satisfactorily pressed together without producing any oxide layer in the materials, thus facilitating the formation and separation process. In this case, the heating is preferably limited to the vicinity of the nose zone where the conical shaping process is being undertaken.

It is also noted that the embodiments illustrated disclose the instances wherein a solid material is employed as the internal member 2 and also that only two billets are produced. However, the invention is equally applicable to a case where the internal member 2 is made of a hollow pipe material wherein it is of course possible to satisfactorily obtain a compound pipe material. In such a case, the internal material 2 in FIG. 1 is also a hollow material, and the sealing and air-discharging operations can be undertaken in the same manner as described above. The only difference is the fact that a similar compound material tube billet can be obtained by means of inserting a metal core or mandrel, of a diameter equal to the inner diameter of the compound billet, into the internal member 2 prior to the time of forming and separating the conical sections shown in FIGS. 1 and 4. When producing a compound-material pipe by employing such a compound-material pipe billet in the extrusion process, it is obvious that such a compound material tube can be obtained by extrusion through the die 10 after insertion of a mandrel through the members 1 and 2.

The drawings illustrate further that the layers of the billet are formed of only the internal material 2 and external material 1. However, the present invention is naturally applicable to those cases wherein more than two members are to be employed for producing compound billets in exactly the same manner, and, it is further evident, that, from a single billet blank, not only two pieces of completed compound billet bodies are available, but also three or more of such bodies can be produced, as shown in FIG. 7, by means of selecting the length of the compound billet blank to be a multiple of the length of the completed compound billet bodies. In the case where more than three completed compound billet bodies are to be produced, it is possible to employ a sealing structure wherein the air-tight sealing of both ends of the external material 1 may be effected through pressure sealing methods without employing stoppers 3.

As described in the foregoing, the present invention provides the advantage in facilitating obtaining compound billets as blanks for producing compound structures, either hollow or solid, through a hydrostatic extrusion process, and further by means of the present invention it is possible to simultaneously obtain a plurality of billets from a length of billet raw material, thus obtaining billets possessing a shape favorable to be treated under an extrusion process without any possibility of breakage of the external material itself or the internal material rupturing through the external material whereby a stable extrusion operation can be undertaken for producing compound billets efficiently and economically.

Obviously, many changes and modifications of the present invention are possible in light of the above teachings. It is to be understood therefore, that within the scope of the appended claims, the invention may be practiced otherwise than as specifically described herein.

What is claimed as new and desired to be secured by letters patent of the United States is:

1. A method of producing compound billets wherein a substantially cylindrical internal member of one metallic material is sealed within a substantially tubular external member of a different metallic material, comprising the steps of:

cleaning those surfaces of said internal member and said external member which are to be brought into contact with each other;

positioning said internal member within said external member, whereby the external and internal peripheral surfaces, respectively, thereof are brought into contact with each other so as to provide a compound billet blank;

sealing the interior of the external member while the interior is under vacuum conditions; and performing a plastic forming process upon the external portion of said compound billet blank, while the interior space of said external member is maintained in said vacuum condition, so as to obtain a compound billet product which is provided with a conical shaped nose portion wherein said internal and external members are bonded together at the contacting surfaces due to said plastic forming, the cross-sectional configuration of said formed and bonded nose portion therefore presenting approximately the same surface areas for both of said external and internal members.

2. A method as set forth in claim 1, wherein said forming process is applied to said compound billet blank at a position other than its longitudinally opposed end portions so as to thereby obtain a plurality of compound billet products from said blank.

3. A method as set forth in claim 1, wherein upon sealing of said interior of said external member, the pressure within said space is less than $10^{-2}$ torr.

4. A method as set forth in claim 1, wherein upon sealing of said interior of said external member, the pressure within said space is less than $10^{-3}$ torr.

5. A method as set forth in claim 1, wherein said forming process step comprises the use of a pair of die members each of which is provided with a blank-engaging surface which has a configuration complementary to the desired cone-shaped nose portion of said compound billet product, and wherein said compound billet blank is forcibly pinched and rotated between said die members, whereby said compound billet may be formed into said compound billet product having said cone-shaped nose portions.

6. A method as set forth in claim 5, wherein each of said die members is of a wedge-shaped configuration.

7. A method as set forth in claim 1, wherein said forming process step comprises the use of a pair of rotating cutters each of which is provided with a blank-engaging knife edge which has a configuration complementary to the desired cone-shaped nose portion of said compound billet product, and wherein said compound billet blank is forcibly pinched between said cutters and said blank and cutters are synchronously rotated so as to thereby form said compound billet product having said cone-shaped nose portions.

8. A method as set forth in claim 1 wherein at least one of said surfaces of said internal member and said external member which are to be brought into contact with each other, prior to said cleaning step, is subjected to a preliminary step whereupon said at least one of said surfaces is formed with a convex portion at a suitable location which is subsequently to be subjected to said forming process.

9. A method as set forth in claim 1 wherein said forming process comprises the additional step of terminating said nose portion in an end portion such that said internal and external members are in a substantially parallel relation with respect to each other in cross section, the shearing stress at the boundary location of said internal member with said external member being equal to or greater than the yield stress of one of said members of different metallic materials which has a greater deformation resistance.

10. A method as set forth in claim 1 wherein said sealing process further comprises sealing at least one of the external member with a closure member by means of resistance welding.

11. A method as set forth in claim 1 wherein at least one of said surfaces of said internal member and said external member which are to be brought into contact with each other, prior to said cleaning step, is subjected to a preliminary step whereupon said at least one of said surfaces is formed with a concave portion at a suitable location which is to be subsequently subjected to said forming process.

* * * * *